US005197525A

United States Patent [19]

Cantor

[11] Patent Number: 5,197,525

[45] Date of Patent: Mar. 30, 1993

[54] ANTI-THEFT HANDBAG

[76] Inventor: Joseph L. Cantor, 31 Canfield Rd., E. Hanover, N.J. 07936

[21] Appl. No.: 660,666

[22] Filed: Feb. 25, 1991

Related U.S. Application Data

[63] Continuation-in-part of Ser. No. 368,412, Jun. 16, 1989, Pat. No. 4,995,436.

[51] Int. Cl.[5] ..... A45C 1/02; A45C 3/06; A45C 13/18; A45C 13/22

[52] U.S. Cl. ..... 150/102; 150/107; 150/108; 150/111; 150/113; 190/101; 190/108; 190/110; 190/116; 383/37

[58] Field of Search ..... 190/101, 116, 102, 108, 190/109, 110; 150/101, 102, 111, 113, 117, 107; 383/11, 37, 40; D3/71

[56] References Cited

U.S. PATENT DOCUMENTS

| | | | |
|---|---|---|---|
| D. 182,126 | 2/1958 | Kontoff et al. | D3/71 X |
| D. 224,072 | 6/1972 | Rosenblum | 150/113 X |
| 2,851,076 | 9/1958 | Stakofsky . | |
| 3,696,850 | 10/1972 | Rosenblum | 190/108 |
| 3,727,657 | 4/1973 | Landis | 150/111 X |
| 3,831,651 | 8/1974 | Leahy | 150/111 X |
| 3,881,534 | 5/1975 | Gist | 190/101 X |
| 4,164,308 | 8/1979 | Gautier | 150/112 X |
| 4,424,841 | 1/1984 | Smith | 190/108 X |
| 4,744,446 | 5/1988 | Arney | 190/108 |
| 4,804,122 | 2/1989 | Knox | 150/102 X |
| 4,995,436 | 2/1991 | Cantor | 150/102 |

FOREIGN PATENT DOCUMENTS

| | | | |
|---|---|---|---|
| 3600794 | 8/1986 | Fed. Rep. of Germany | 190/110 |
| 840343 | 7/1960 | United Kingdom | 190/110 |

*Primary Examiner*—Sue A. Weaver

[57] ABSTRACT

A method and means for protecting valuables is disclosed. An anti-theft handbag is comprised of multiple segments which separate upon extraordinary pulling. A first segment is detachably secured to a second segment via a break-away pocket.

10 Claims, 4 Drawing Sheets

FIG. 1
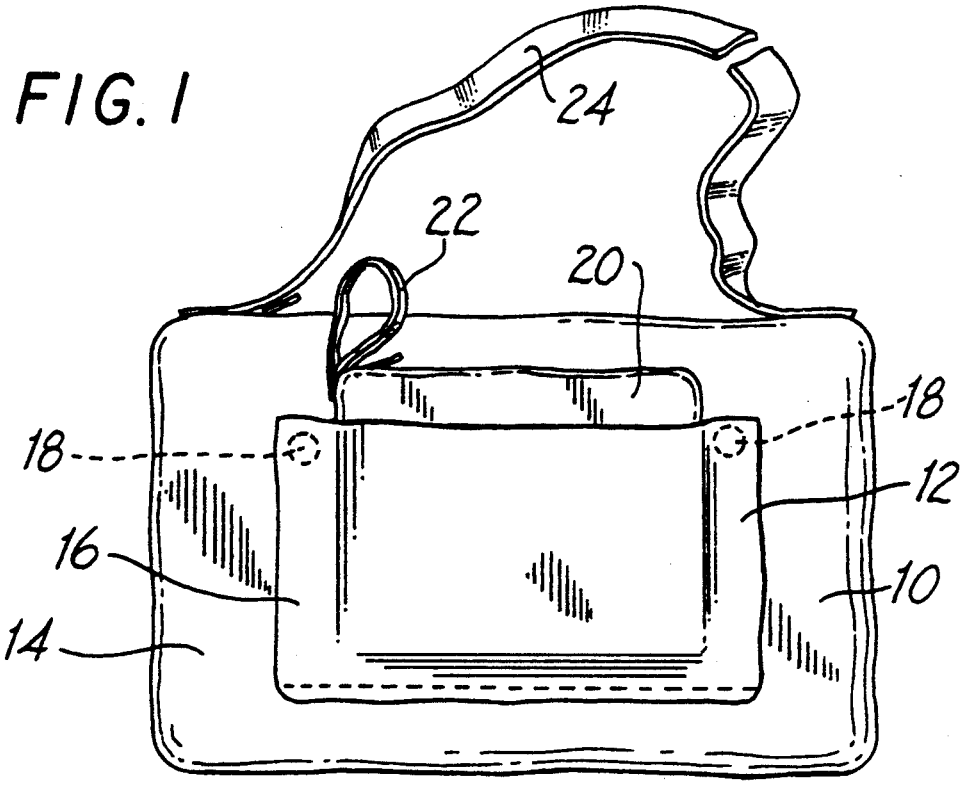
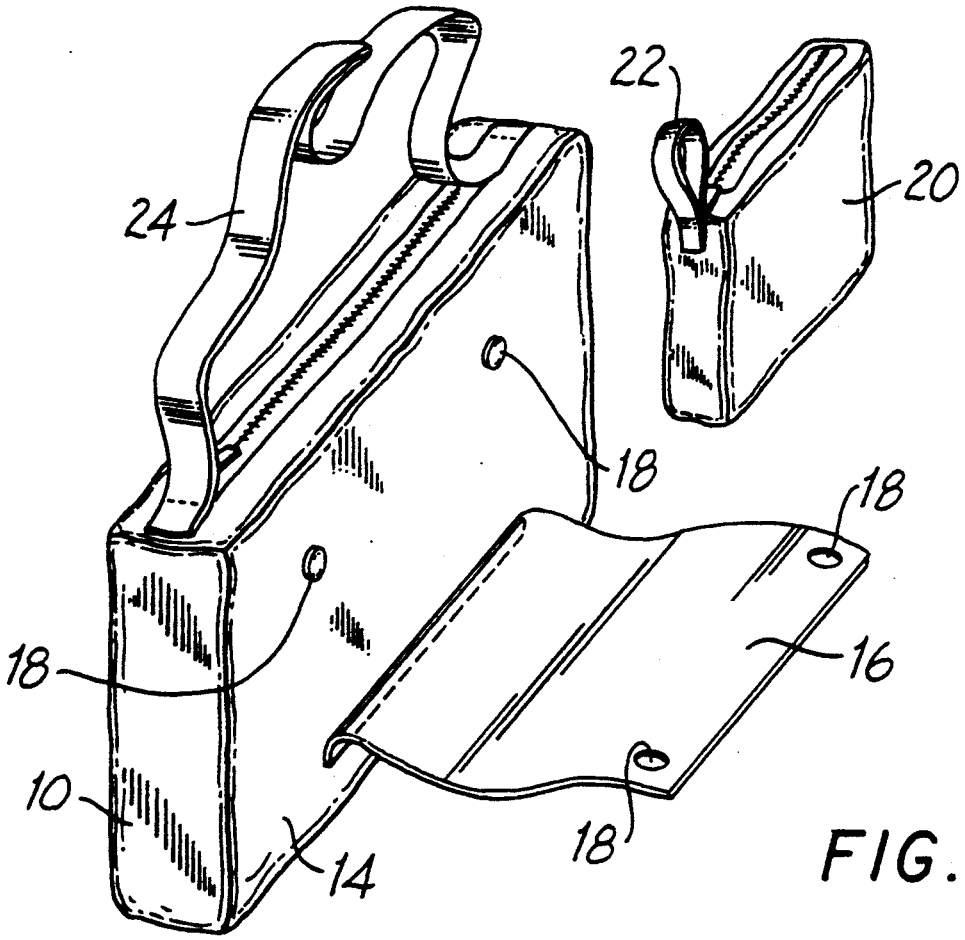
FIG. 2

FIG. 3
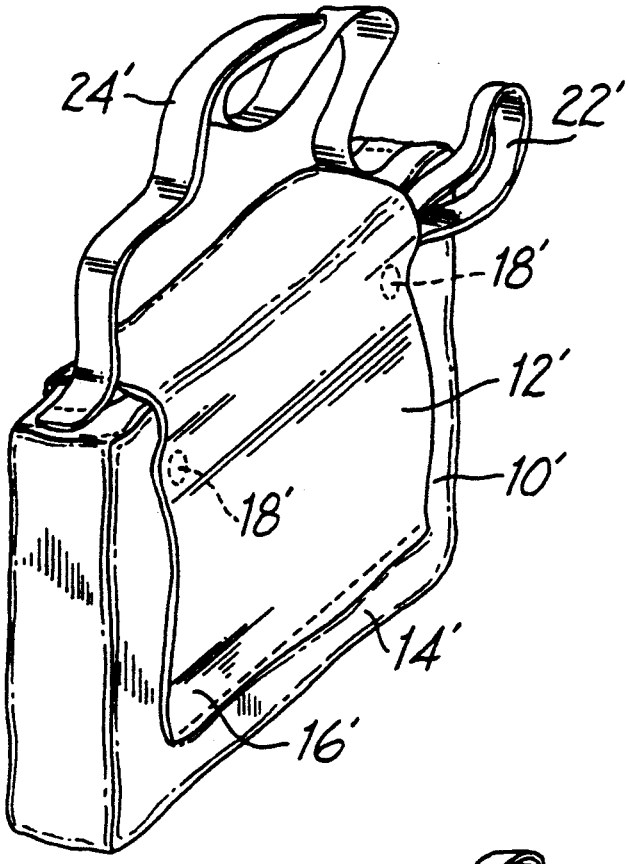
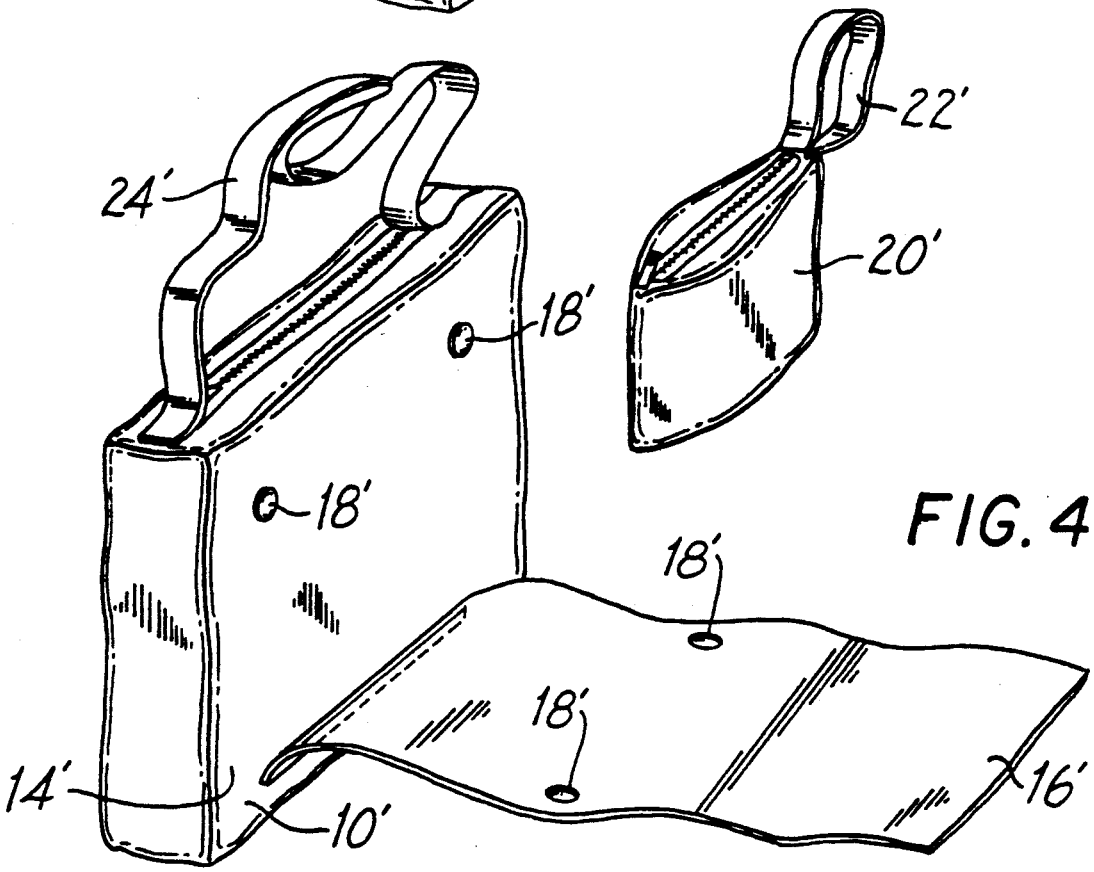
FIG. 4

FIG. 9
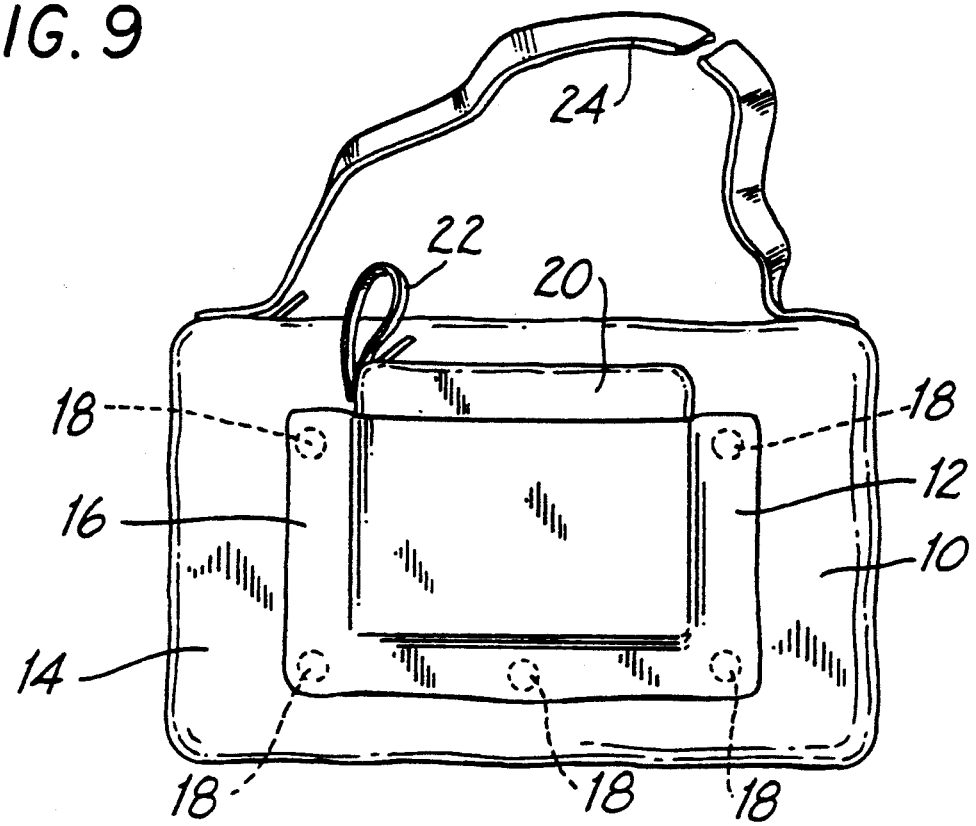
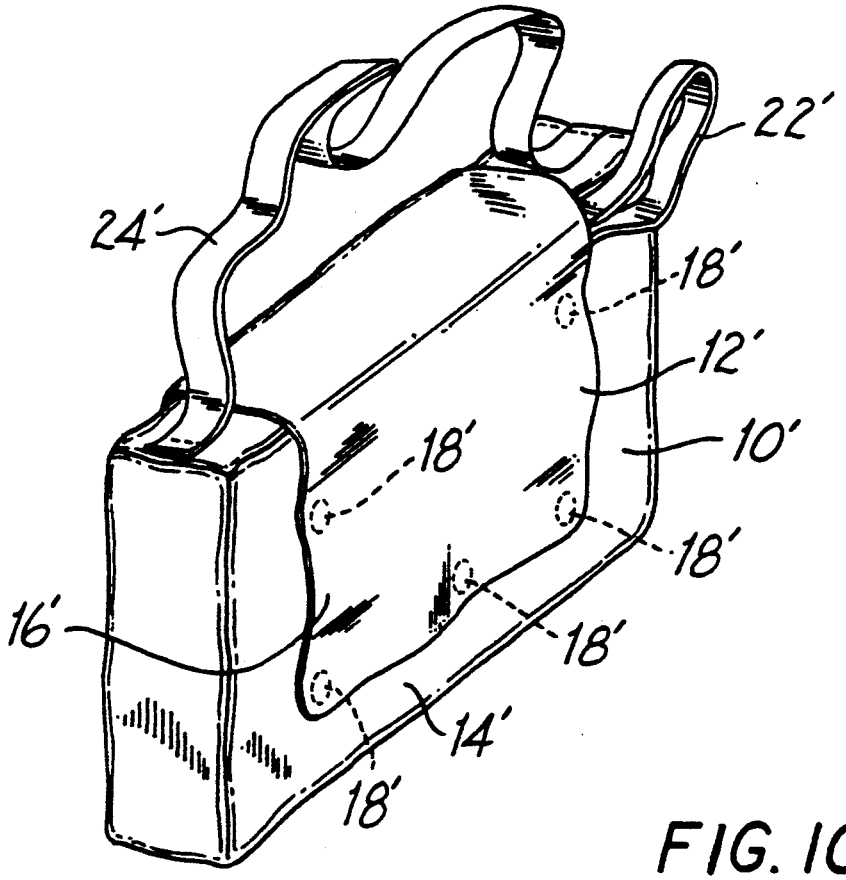
FIG. 10

ANTI-THEFT HANDBAG

This is a continuation-in-part of co-pending application Ser. No. 368,412, filed June 16, 1989.

BACKGROUND OF THE INVENTION

This invention relates to carrying cases designed to prevent the loss of valuables due to theft. Pedestrians or bicycle riders carrying valuables in a handbag or shoulder bag in a modern crowded urban environment should be concerned with the possibility that a thief could snatch the bag and steal any valuables contained therein.

Unfortunately, the victim of a so-called "purse snatching incident" is commonly pulled or dragged along as the thief yanks the carrying case or the strap associated with the case. Such an occurrence can severely jeopardize the life or limb of the victim, especially near a crowded motorway.

Various attempts have been made to solve these problems but until the instant invention, these attempts have been unsatisfactory because of clumsiness, expense, unsightliness and the lack of an adequately safe and frictionless release system.

The present invention solves these problems by providing a unique system of easily detachable and reattachable adjacent bag segments, some of which remain secure with the victim during a purse snatching incident while others detach and act to decoy the thief.

Accordingly, it is an object of this invention to provide the handbag holder with a means of safely securing valuables during a purse snatching incident.

Another object of this invention is to insure that the victim of a purse snatching incident is not dragged along with the stolen handbag.

Yet another object of this invention is to insure a quick and relatively frictionless separation of handbag segments during a purse snatching incident thus allowing the victim to disengage from the perpetrator as quickly as possible.

A further object of this invention is to dupe a thief into believing that he or she has made off with their booty, thus minimizing the risk that the thief will continue to harass the victim.

A still further object of this invention is to provide a cosmetically and artistically appealing design that is light in weight with a minimum of encumbrances, all contained in a convenient and highly functional device.

All the foregoing and still further objects and advantages of this invention will become apparent from a study of the following specification.

BRIEF DESCRIPTION OF THE DRAWINGS

FIG. 1 is a back view of a handbag embodying this invention.

FIG. 2 is an exploded perspective view of the handbag as in FIG. 1.

FIG. 3 is a perspective view of a second handbag embodying this invention.

FIG. 4 is an exploded view of the handbag as in FIG. 3

FIG. 9 is a back view of another handbag embodying the invention.

FIG. 10 is a perspective view of the handbag depicted in FIG. 9.

DETAILED DESCRIPTION OF THE INVENTION

Figure 5:
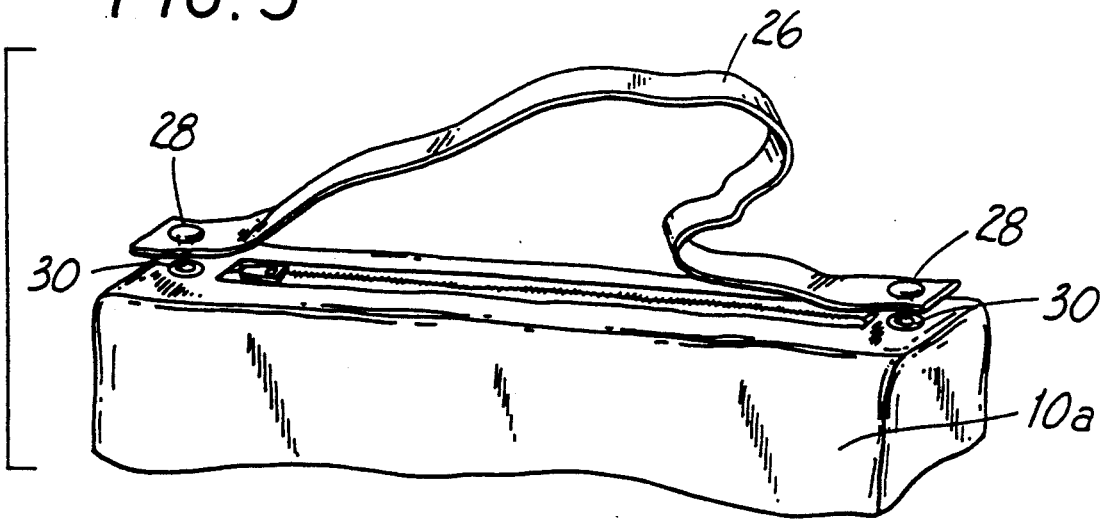
FIG. 5 is a fragmentary view of the anti-theft handbag depicting a carrying strap that can be removably and reattachably mounted at both ends.

Referring first to the forms shown in FIGS. 1 and 2 of the drawings, this example of the invention embodies two adjacent bag segments. A decoy bag segment 10 has a pocket 12 mounted to a side wall 14. The pocket 12 is formed by a flap 16 which is permanently mounted at its bottom to the side wall 14. The permanent mounting may be accomplished by stitching or a metal fastener or glue or such other means as those with skill in the art would use. The top of the pocket 12 is releasibly secured to the side wall 14 by an attaching means 18. The attaching means 18 may be a snap or Velcro® or the like. Velcro® is a hook-and-loop-type fastener and is a registered U.S. trademark, e.g., Reg. Nos. 1,027,417 or 1,303,907 (Velcro® V). A valuables pouch 20 is appropriately sized to fit within the pocket 12. A hand strap 22 is permanently attached to the valuables bag 20. The decoy bag 10 has a carrying strap 24 attached to it.

FIG. 2 shows the flap 16 disengaged from the mounting means 18. The valuables bag 20 is shown separate from the decoy bag 10.

In normal use, the fully assembled handbag appears to be conventional. The handbag holder drapes the carrying strap 24 over his or her shoulder and lets the bag hang down to a comfortable position (usually about the hip or rib cage area when walking or riding normally). The pocket 12 and valuables bag segment 20 should be positioned so that they are immediately adjacent to or resting against the body of the handbag holder. Consequently, the valuables bag segment 20 is hidden from view. The handbag holder then inserts his or her hand through the handstrap 22 to secure the valuables bag segment 20.

Should a thief attempt to snatch the handbag by grabbing and then exerting an extraordinary pulling force upon the readily available decoy bag segment 10, the decoy bag segment 10 will break away from the valuables bag segment 20. In normal operation, the valuables bag segment 20 will either slide out of the top of the pocket 12, or, exert sufficient force against the pocket to disengage the reattachable mounting means 18 and open the flap 16. As defined herein, extraordinary pulling force is the force that a thief exerts on a handbag or purse in the course of a purse snatching incident. Thus, when the thief grabs the decoy bag segment 10 with the carrying strap 24 and pulls, the handbag holder is left holding the valuables bag segment 20 which has been secured to the handbag holder's wrist by means of the handstrap 22, while the thief runs off with the decoy bag segment 10.

In a preferred embodiment of the invention, the pocket 12 and the valuables bag segment 20 are smaller in size than the decoy bag segment 10 and remains hidden from view. An advantage of this sizing arrangement is that the borders of the decoy bag 10 protrude out beyond those of the valuables bag segment 20. When a thief grabs the decoy bag segment 10, the thief's hand will grab only the protruding decoy bag segment 10. Furthermore, an oversize decoy bag segment 10 will camouflage the fact that the handbag holder is holding or otherwise securing the smaller valuables bag segment 20.

Referring now to the forms shown in FIGS. 3 and 4 of the drawings, this example of the invention is similar in many respects to the example shown in FIGS. 1 and 2 except that the pocket 12' is formed from a flap 16' which is capable of going up, over, and around the top of the decoy bag 10'. The valuables bag segment 20' fits into the pocket 12' and the flap 16' is folded over the top of the decoy bag segment 10'. The handstrap 22' projects sidewardly out of the pocket 12'. The wrap-around strap 16' offers the advantage of almost completely concealing the valuables bag segment 20'.

Figure 6:
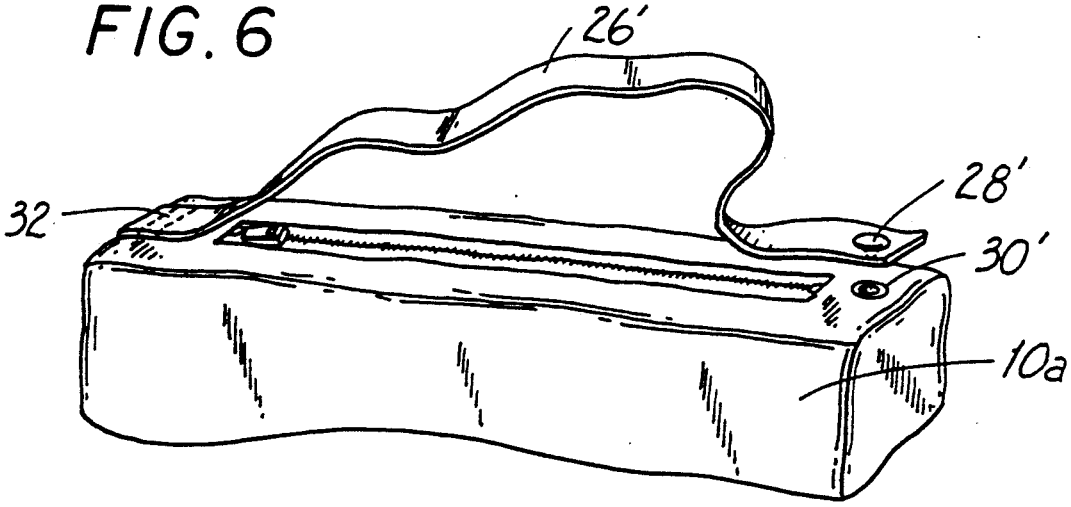
FIG. 6 is a fragmentary view of the anti-theft handbag depicting a carrying strap that is permanently attached at one end and reattachable at the other end.

Occasionally, a handbag holder may drape the carrying strap 24 or 24' around his or her neck so that the carrying strap 24 or 24' lies across the chest or abdominal region in diagonal fashion. If the thief grabs or pulls the carrying strap 24 or 24' and the carrying strap 24 or 24' is permanently secured to the decoy bag segment 10 or 10' the handbag holder may be dragged along by the thief. FIG. 5 illustrates an example of a carrying strap 26 which is reattachably mounted at both of its ends to the decoy bag 10*a*. The male portion of a snap 28 is reattachably mateable with the female portion of the snap 30 and forms a means for detachably securing the carrying strap 26 to the decoy bag segment 10*a*. FIG. 6 illustrates an example of a carrying strap 26' permanently attached to the decoy bag segment 10*a* at one end 32 by such means as those with skill in the art would normally use and reattachably attached at the other end by means of the male snap portion 28' and female snap portion 30'

If a thief grabs and pulls the fully detachable carrying strap 26, the carrying strap 26 will detach at one or either both of the points at which the carrying strap 26 is attached to the decoy bag segment 10*a*. When both ends of the carrying strap 26 release, the thief will abscond only with the carrying strap 26. If one end of the carrying strap 26' is permanently attached to the decoy bag segment 10*a*, a thief grabbing the carrying strap 26' will abscond with the carrying strap 26' and the permanently attached decoy bag segment 10*a*. The advantage of a detachable carrying strap 26 or 26' is made apparent under these circumstances because without a releasing mechanism, the handbag holder would be dragged along as the thief pulls the carrying strap or the decoy bag segment.

Figure 7:
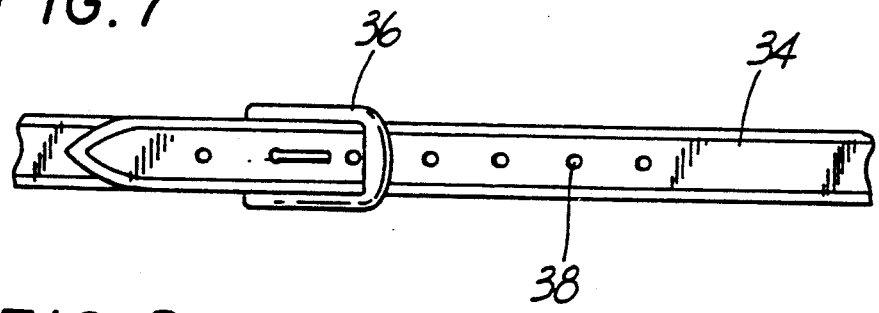
FIGS. 7 and 8 are fragmentary top views of adjustable carrying straps and adjusting means.
Figure 8:
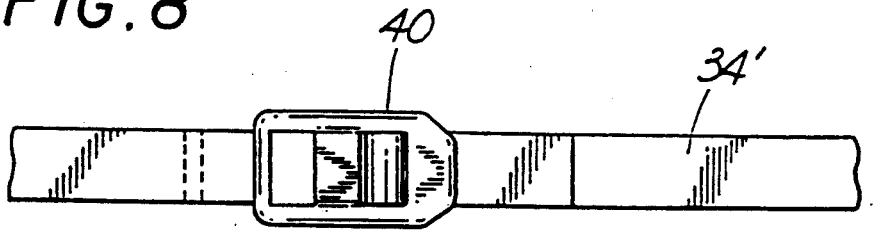

In any case, all the above-described carrying straps may be made adjustable in length by any such means are known to those with skill in the art. For example, as can be seen from FIG. 7, an adjustable carrying strap 34 may be made adjustable by means of a buckle assembly 36 and holes 38, or, as is shown in FIG. 8, an adjustable carrying strap 34' may be made adjustable by means of a sliding release buckle 40.

In an alternative embodiment of the instant anti-theft handbag the flap 16 or 16' may be removable at all points of attachment. FIG. 9 illustrates an embodiment substantially similar to the embodiment shown in FIG. 1 except that the flap 16 is not permanently mounted to the side wall 14. Each point of attachment to the side wall is releasably accomplished through attaching means 18. Therefore, if a thief grabs the decoy bag segment 10 or the carrying strap 24, a properly secured valuables segment 20 will either slide out of the top of the pocket 12, or, exert sufficient force against the pocket 12 to disengage any or all of the reattachable mounting means 18 and open all or part of the flap 16, thus releasing the valuables bag segment 20 from the decoy bag segment 10. A reattachable mounting means 18 may be placed near the center of the bottom of the flap 16 to prevent the valuables bag segment 20 from sliding through the bottom of the pocket 12.

Similarly, FIG. 10 illustrates the same principles in an embodiment similar to FIG. 4. As above, the flap 16' is reattachably mounted at all connection points by reattachable mounting means 18'.

While the description herein highlights the benefits and advantages of the present invention under the circumstances of a theft, the inventive concept also applies to situations that occur when the carrying strap or decoy bag is inadvertently hooked to a passing or stationary object. In such situations, the present invention functions as a safety device. For example, a fast-closing subway door may inadvertently close on a victim's handbag. The instant invention would function as previously described, i.e., separating at the aforementioned attaching means and leaving the victim safe and secure with their valuables. In the case of a moving bicycle rider who inadvertently catches the invention would function as above to produce the same safe result.

In all the embodiments of this invention, the bag segments may exist in varying sizes and shapes such as square, rectangular, circular, or any other shape which may be convenient or pleasing to the eye. It is also contemplated that the present inventive concept also encompasses larger size shoulder bags. Furthermore, the bag segments may open and close to reveal storage areas contained within the bag segments. Such opening and closing means may comprise zippers, flaps or any other mechanism which may seal the bag segment that those with skill in the art may apply.

The examples and embodiments depicted in the specification are not intended to be limitations on the inventive concept herein. Accordingly, other modifications in the shape, size, form or interchangeability of bag segments may be made which are intended to be covered by this invention.

What is claimed is:

1. An anti-theft handbag device comprising a first handbag segment, a second handbag segment and a means for detachably securing said first handbag segment adjacently to said second handbag segment, said means for detachably securing comprising a break-away pocket exteriorly mounted to said second handbag segment said break-away pocket being adapted to receive said first handbag segment, and further adapted to open and release said first handbag segment upon extraordinary pulling.

2. An anti-theft handbag according to claim 1 wherein a bottom of said break-away pocket is permanently secured to said second handbag segment and a top of said break-away pocket is comprised of a means for being removably attached to said second handbag segment whereby upon extraordinary pulling said top of said break-away pocket disengages from said second handbag segment.

3. An anti-theft handbag according to claim 1 wherein said second handbag segment has a carrying strap mounted thereon.

4. An anti-theft handbag according to claim 3 wherein both ends of said carrying strap are comprised of means for removably and re-attachably mounted said carrying strap to said second handbag segment.

5. An anti-theft handbag according to claim 3 wherein one end of said carrying strap is permanently mounted to said second handbag segment, and the other end of said carrying strap is comprised of means for removably and reattachably mounting said carrying strap to said second handbag segment.

6. An anti-theft handbag according to claim 3 wherein said carrying strap further comprises strap length adjusting means.

7. An anti-theft handbag according to claim 1 wherein a handstrap is mounted to said first handbag segment.

8. An anti-theft handbag according to claim 1 wherein said second handbag segment is larger than said first handbag segment.

9. A method of securing valuables which comprises 1) removably attaching adjacent bag segments to one another by means of a break-away pocket exteriorly attached to a first one of said adjacent bag segments adapted to receive and support another smaller one of said adjacent bags, said break-away pocket supporting one of said smaller adjacent bags against said first one of said adjacent bags; 2) positioning said adjacent bag segments such that said break-away pocket containing said smaller one of said adjacent bag segments is against the body of a holder of said adjacent bag segments; 3) placing a carrying strap which is attached to said first one of said adjacent bag segments over a shoulder of said holder of said adjacent bag segments such that said adjacent bag segments hang and are supported by said carrying strap; 4) placing a hand of said holder of said adjacent bag segments through a handstrap which is attached to said smaller one of said adjacent bags, said handstrap protruding out of said break-away pocket wherein said first one of said adjacent bag segments is a decoy bag and said smaller one of said adjacent bags is a valuables containing bag which remains secure to said holder of said adjacent bag segments by means of said handstrap when extraordinary pulling is exerted upon said first one of said adjacent bag segments or said carrying strap, thereby causing separation of said adjacent bag segments and disintegration of said break-away pocket.

10. A method of securing valuables according to claim 9 wherein at least one end of said carrying strap is reattachably and removably attached to said first one of said adjacent bag segments.

* * * * *